US006024296A

United States Patent [19]

Wear et al.

[11] Patent Number: 6,024,296

[45] Date of Patent: Feb. 15, 2000

[54] DIRECT CONTROL FUEL INJECTOR WITH DUAL FLOW RATE ORIFICE

[75] Inventors: Jerry A. Wear, East Peoria; Lianghe Zuo, Chicago, both of Ill.

[73] Assignee: Caterpillar, Inc., Peoria, Ill.

[21] Appl. No.: 09/131,554

[22] Filed: Aug. 10, 1998

[51] Int. Cl.[7] ..... F02M 45/00; F02M 47/02; B05B 1/30

[52] U.S. Cl. ..... 239/88; 239/90; 239/93; 239/95; 239/96; 239/533.4; 239/533.5; 239/533.8; 239/585.1; 239/585.5

[58] Field of Search ..... 239/88, 89, 90, 239/91, 92, 93, 94, 95, 96, 124, 533.4, 533.5, 533.8, 585.1, 585.2, 585.4, 585.5

[56] References Cited

U.S. PATENT DOCUMENTS

| | | | |
|---|---|---|---|
| 4,605,166 | 8/1986 | Kelly | 239/96 |
| 5,505,384 | 4/1996 | Camplin | 239/533.5 |
| 5,597,118 | 1/1997 | Carter, Jr. et al. | 239/92 |
| 5,873,526 | 2/1999 | Cooke | 239/88 |

*Primary Examiner*—Andres Kashnikow
*Assistant Examiner*—Robin O. Evans
*Attorney, Agent, or Firm*—Michael McNeil

[57] ABSTRACT

A fuel injector includes an injector body that defines a nozzle outlet, and a needle control chamber that is in fluid communication with a needle control passage. A needle valve member is positioned in the injector body, and has a closing hydraulic surface exposed to fluid pressure in the needle control chamber. The needle valve member is moveable between a first position in which the nozzle outlet is blocked, and a second position in which the nozzle outlet is open. The needle control passage includes a dual flow rate orifice. Hydraulic fluid is displaced into the needle control chamber through the dual flow rate orifice when the needle valve member moves from its second position toward its first position. Hydraulic fluid is displaced out of the needle control chamber through the dual flow rate orifice when the needle valve member moves from its first position toward its second position. A compression spring is operably positioned to bias the needle valve member toward its first position.

20 Claims, 3 Drawing Sheets

DIRECT CONTROL FUEL INJECTOR WITH DUAL FLOW RATE ORIFICE

TECHNICAL FIELD

The present invention relates generally to fuel injectors having direct control needle valves, and more particularly to the incorporation of a dual flow rate orifice in the fluid pressure passage that controls the opening and closing of the needle valve in such a fuel injector.

BACKGROUND ART

In an effort to gain more control over fuel injection timing, quantity and rate shaping, a class of fuel injectors has evolved with the ability to directly control the position of the needle valve that opens and closes the nozzle outlet. In many of these types of fuel injectors, the needle valve member includes a closing hydraulic surface exposed to fluid pressure in a needle control chamber. A separate needle control valve has the ability to expose the needle control chamber to either low or high pressure, independent of fuel injection pressure and engine crank shaft position. This permits the injection quantity and timing to be precisely controlled and optimized based upon sensed operating conditions, such as engine load and speed, etc. This control permits engineers to provide an improved balance between undesirable exhaust emissions and engine performance across an engine's operating range. However, there remains room for improvement, particularly in the area of rate shaping each injection event to further improve combustion efficiency at various engine operating conditions.

Engineers have come to recognize that undesirable exhaust emissions can often be reduced if each injection event ends as abruptly as possible. Many fuel injectors with directly controlled needle valves can accomplish abrupt needle closure since they have the ability to close the needle valve even while fuel injection pressures are relatively high. On the front side of each injection vent, engineers have observed that undesirable exhaust emissions can often be reduced over much of an engine's operating range if the injection event begins more gradually. Since gradual beginning and abrupt ending to injection events often places contradictory constraints on the workings of an individual fuel injector, there remains room to improve the rate shaping characteristics of fuel injectors with direct control needle valves.

The present invention is directed to overcoming these and other problems associated with rate shaping in fuel injectors having direct control needle valves.

DISCLOSURE OF THE INVENTION

In one aspect, a nozzle assembly includes a nozzle body that defines a nozzle outlet, and a needle control chamber in fluid communication with a needle control passage. A needle valve member is positioned in the nozzle body, and has a closing hydraulic surface exposed to fluid pressure in the needle control chamber. The needle valve member is moveable between a first position in which the nozzle outlet is blocked, and a second position in which the nozzle outlet is open. The needle control passage includes a dual flow rate orifice. The needle valve member displaces fluid from the needle control chamber through the dual flow rate orifice when moving from its first position to its second position.

BEST MODE FOR CARRYING OUT THE INVENTION

Figure 1:
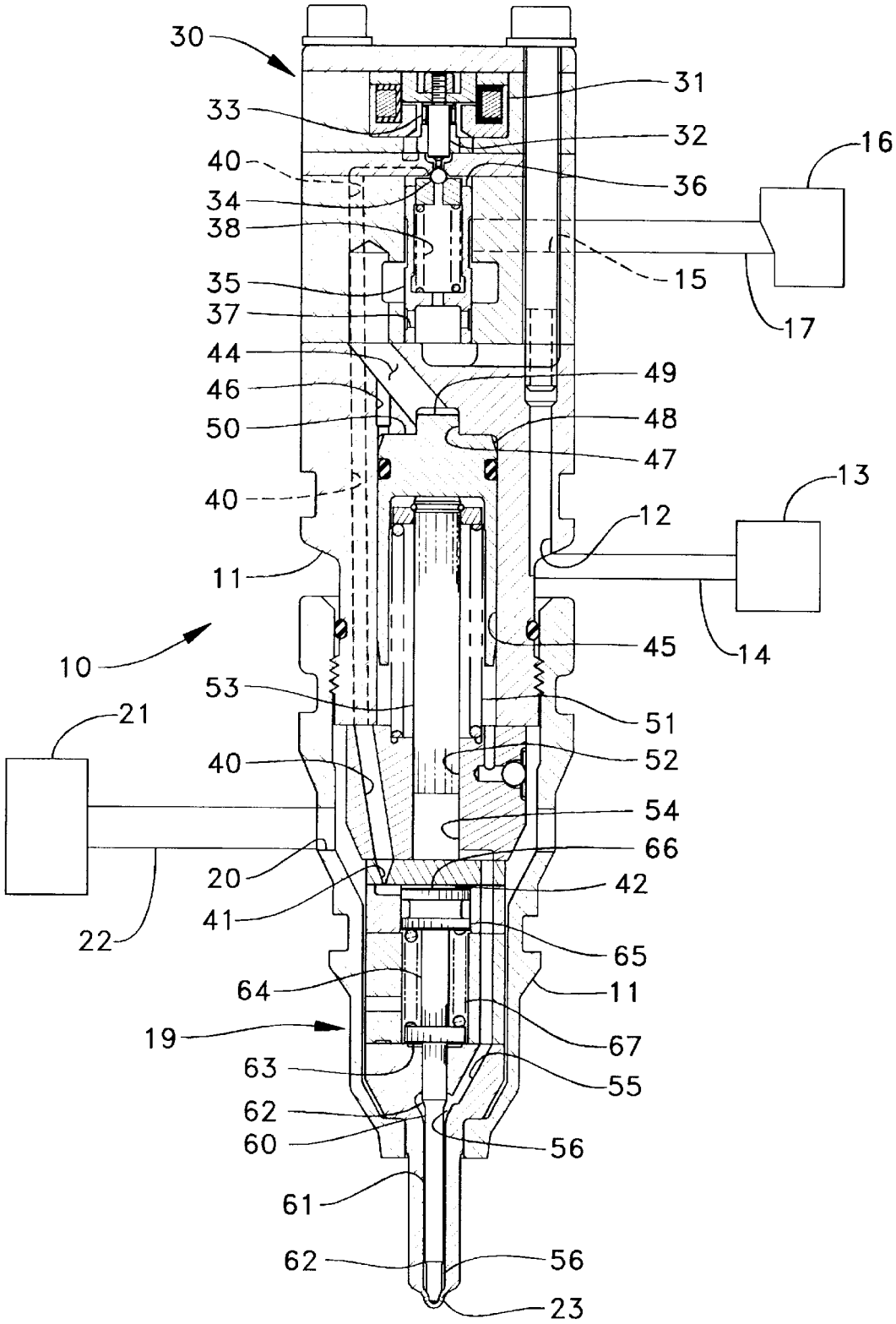
FIG. 1 is a sectioned side diagrammatic view of a fuel injector with a direct control needle valve according to one aspect of the present invention.
Figure 2:
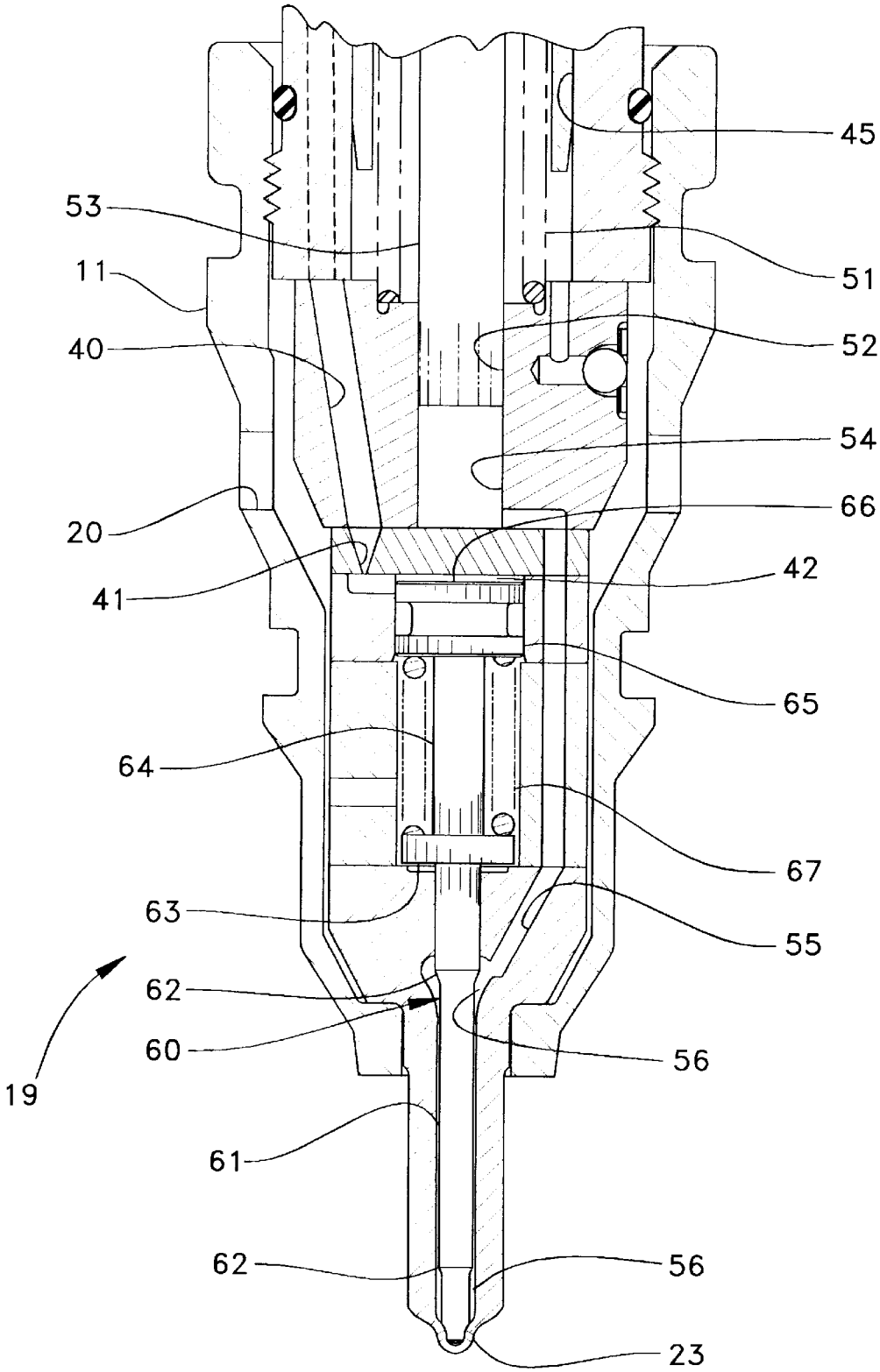
FIG. 2 is a sectioned side diagrammatic view of the nozzle assembly portion of the fuel injector shown in FIG. 1.

Referring now to FIGS. 1 and 2, a fuel injector 10 includes an injector body 11 made up of various components attached to one another in a manner well known in the art. Fuel injector 10 includes an upper control valve assembly 30, a central means for hydraulically pressurizing fuel, and a lower nozzle assembly 19 with a direct control needle valve member 60. Injector body 11 defines an actuation fluid inlet 12 connected to a source of high pressure actuation fluid, such as engine lubricating oil, via an actuation fluid supply passage 14. In addition, injector body 11 defines a low pressure actuation fluid drain 15 that is connected to a low pressure reservoir 16 via a drain passage 17. Finally, injector body 11 defines a fuel inlet 20 connected to a source of fuel fluid 21 via fuel supply passage 22. Thus, in this embodiment, fuel injector 10 uses one fluid, such as engine lubricating oil as a hydraulic medium, and a different fluid, such as distillate diesel fuel, as its fuel fluid.

Fuel injector 10 includes a single two-position solenoid 31 that controls both the hydraulic means for pressurizing fuel and the needle control aspects of the injector. Solenoid 31 includes an armature that is attached to a pin 32. A biasing spring 33 normally biases pin 32 upward to a position out of contact with a ball valve member 34, which is trapped between an upper low pressure conical valve seat and a lower high pressure conical valve seat. A needle control passage 40 opens at one end between the high low and pressure seats that trap valve ball member 34, and on its other end into a needle control chamber 42, which is located in nozzle assembly 19. When ball valve member 34 is in its upward position seated to close the low pressure conical seat, needle control chamber 42 is opened to the high pressure of actuation fluid inlet 12 via needle control passage 40 and the hollow interior of a spool valve member 35. When ball valve 34 is in its downward position to close its high pressure seat, needle control chamber 42 is open to a hidden low pressure passage, which is adjacent pin 32, via needle control passage 40. When solenoid 31 is energized, pin 32 holds ball valve 34 in its downward position to close the high pressure seat. When solenoid 31 is de-energized, high fluid pressure acting on ball valve member 34 urges it upward to close its low pressure seat.

The hydraulic means for pressurizing fuel within fuel injector 10 is controlled by the movement of a separate spool valve member 35, which includes an annular hydraulic surface 36 and a plurality of radial openings 37. When solenoid 31 is deactivated, spool valve member 35 is urged downward to the position shown by the action of an internal biasing spring 38. When spool valve member 35 is in its downward position as shown, an actuation fluid cavity 44 is opened to low pressure actuation fluid drain passage 15 past an annulus in the outer surface of spool valve member 35. When spool valve member 35 is moved to its upward position, actuation fluid cavity 44 becomes closed to drain passage 15, but opens to the high pressure of actuation fluid inlet 12 via radial openings 37. Spool valve member 35 is moved to this upward position by energizing solenoid 31 to push ball valve member 34 downward to close its high pressure seat, thus relieving the high pressure on annual hydraulic surface 36 and creating a hydraulic imbalance in the spool valve member 35. This causes spool valve member 35 to move upward against the action of internal biasing spring 38. Between injection events, spool valve member 35 is positioned in its downward position, as shown. Each injection event is initiated by moving spool valve member upward to open actuation fluid cavity 44 to the high pressure of actuation fluid inlet 12.

In order to hydraulically pressurize the fuel within injector body 11, a reciprocating intensifier piston 48 is positioned in a piston bore 45, and is moveable between an upward retracted position, as shown, and a downward advanced position. Intensifier piston 48 includes a stepped top 49 that is opened to actuation fluid cavity 44 via an unrestricted passage 47, and an annular shoulder 50 opened to actuation fluid cavity 44 via a restricted passage 46. Intensifier piston 48 is connected to move with a plunger 53, which is positioned to reciprocate in a plunger for 52 between an upward retracted position and a downward advanced position. Plunger 53 and intensifier piston 48 are biased upward toward their retracted positions by a return spring 51. During an injection event, plunger 53 is driven downward by the high hydraulic fluid pressure acting on the top of intensifier piston 48 to pressurize fuel in a fuel pressurization chamber 54, which is defined by plunger bore 52 and a portion of plunger 53.

Fuel pressurization chamber 54 is connected to a nozzle outlet 23 via a nozzle supply passage 55 and a nozzle chamber 56. A needle valve member 60 is positioned in injector body 11, and moveable between a downward first position in which nozzle outlet 23 is blocked, and an upward second position in which nozzle outlet 23 is open. In this embodiment, needle valve member 60 includes a needle portion 61, a spacer portion 63, a pin portion 64, and a piston portion 65. Needle valve member 60 is biased downward to a position that closes nozzle outlet 23 by a biasing spring 67. Although needle valve member 60 is shown in this embodiment as made up of several individual components, it could be machined from a single solid piece of a suitable metallic alloy if biasing spring 67 were relocated. In any event, needle valve member 60 includes lifting hydraulic surfaces 62 that are exposed to fluid pressure in nozzle chamber 56, and a closing hydraulic surface 66 exposed to fluid pressure in needle control chamber 42. Preferably, closing hydraulic surface 66 is sized such that needle valve member 60 is biased to its downward closed position when needle control chamber 42 is opened to the high pressure, regardless whether fuel pressure acting on lifting hydraulic surfaces 62 is at high injection pressures. When needle control chamber 42 is opened to low pressure, needle valve member 60 behaves as a simple check valve. In other words, when low pressure is acting on closing hydraulic surface 66, needle valve member 60 will move upward to its opened position when fuel pressure in nozzle chamber 56 is above a valve opening pressure sufficient to overcome biasing spring 67.

Because needle valve member 60 must move some finite distance when moving between its downward closed position and its upward opened position, fluid in needle control chamber 42 must be displaced through needle control passage 40 whenever needle valve member 60 moves. Thus, when needle valve member 60 moves upward, a volume of fluid is displaced from needle control chamber 42 into needle control passage 40. On the other hand, when needle valve member 60 moves downward, a volume of fluid flows into needle control chamber 42. The present invention exploits this inherent fluid displacement to improve the rate shaping of each injection event.

This is accomplished by incorporating a dual flow rate orifice 41 into needle control passage 40. Dual flow rate orifice 41 has a first flow rate coefficient for fluid flow out of needle control chamber, and a second flow rate coefficient for fluid flow into needle control chamber 42. The first flow rate coefficient is preferably substantially smaller than the second flow rate coefficient. By appropriately sizing and shaping dual flow rate orifice 41, the flow out of needle control chamber 42 can be hindered, whereas the flow into needle control chamber 42 can remain substantially unrestricted. Thus, if dual flow rate orifice 41 can produce a flow restriction when needle control valve member 60 is moving upward, its movement can be slowed due to a pressure increase that would naturally occur in needle control chamber 42 while the fluid was being displaced. This can permit the needle valve member to move to its open position more slowly to produce a more gradual beginning to each injection event. However, because dual flow rate orifice permits relatively unrestricted flow into needle control chamber 42, each injection event can still be ended abruptly. Thus, dual flow rate orifice 41 is shaped and sized such that it has a relatively unrestricted flow in this reverse direction when the needle valve member is moving toward its closed position in order to not undermine the abrupt closure rate of the needle valve member at the end of an injection event. In one of its more simplest forms, dual flow rate orifice 41 has a frustoconical shape as shown in FIGS. 1 and 2.

Industrial Applicability

Figure 3:
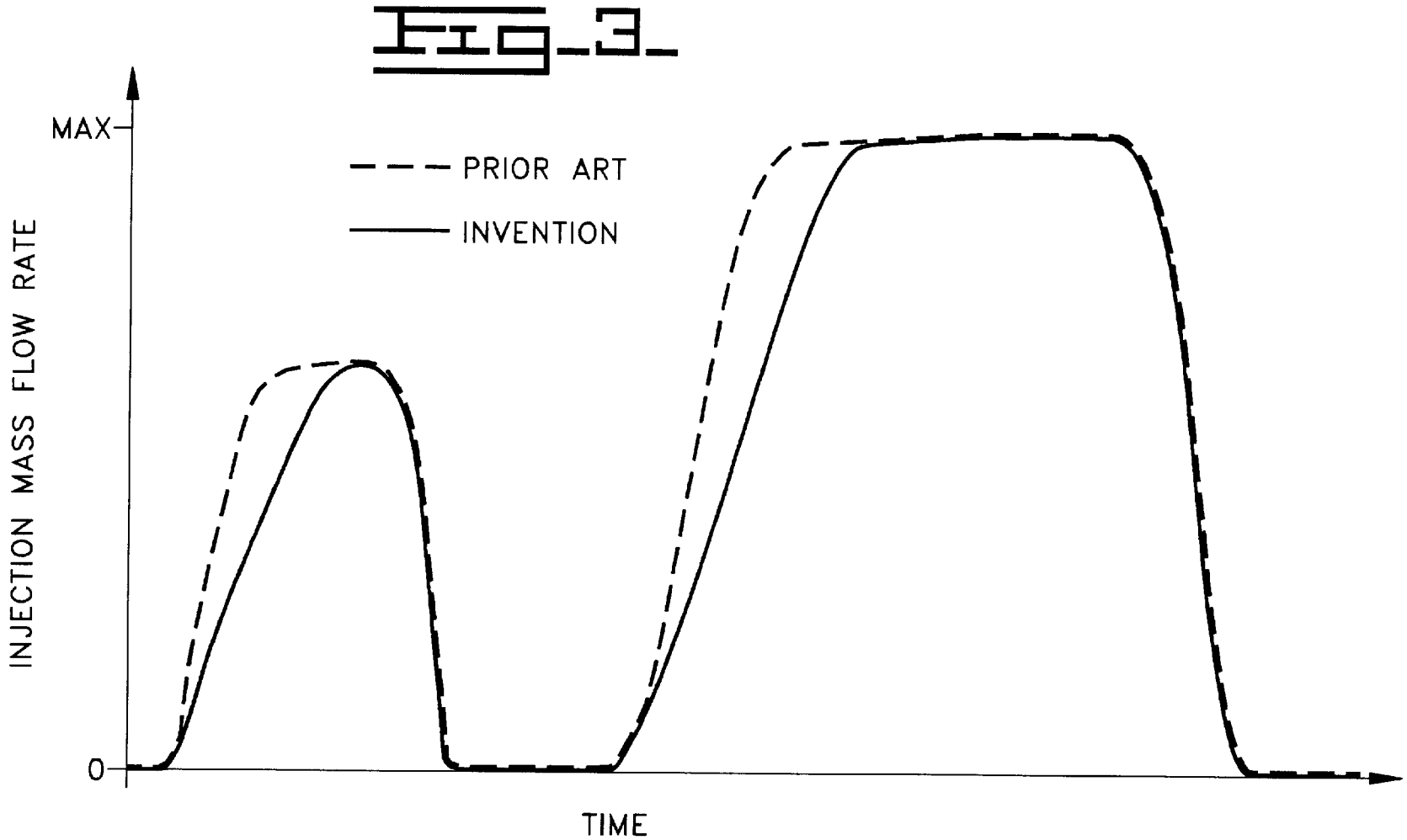
FIG. 3 is a graph of injection mass flow rate versus time for a fuel injector according to the prior art and the present invention.

Referring now in addition to FIG. 3, each injection event is initiated by energizing solenoid 31. Before solenoid 31 is energized, ball valve member 34 is in its upward position to open needle control passage 40 and annular hydraulic surface 36 to the high pressure of actuation fluid inlet 12. Spool valve member 35 is in its downward position, and both piston 48 and plunger 53 are in their upward retracted positions. Finally, needle valve member 60 is in its downward position to close nozzle outlet 23. When solenoid 31 is energized to initiate the injection event, pin 32 is driven downward to move ball valve member 34 to close its high pressure seat. When this occurs, needle control chamber 42 and annular hydraulic surface 36 are abruptly opened to low pressure. This relieves the high pressure acting on closing hydraulic surface 66 of needle valve member 60, and allows spool valve member 35 to move upward to its open position against the action of biasing spring 38. When spool valve member 35 reaches its upward position, high pressure actuation fluid begins to flow into actuation fluid cavity 44 and act upon the top hydraulic surface of intensifier piston 48. This causes piston 48 and plunger 53 to begin their downward pumping stroke.

As plunger 53 is driven downward, fuel in fuel pressurization chamber 54 rises rapidly. When this fuel pressure exceeds a valve opening pressure sufficient to overcome needle biasing spring 67, needle valve member 60 moves upward to open nozzle outlet 23 and commence the spraying of fuel. FIG. 3 shows that by including dual flow rate orifice 41, the beginning portion of the injection event can be made more gradual since the flow restriction produced by the dual flow rate orifice slows the movement of the needle valve member 60 when moving to its upward open position. This more gradual beginning to each injection event is believed to improve exhaust emissions.

In this example, a split injection is desired. In order to accomplish this, solenoid 31 is briefly de-energized. This allows ball valve member 34 to move upward to close its low pressure seat and abruptly open needle control passage 40 to high pressure fluid. This high pressure fluid then flows into needle control chamber 42 and acts on closing hydraulic surface 66 to quickly move needle valve member 60 downward to its closed position. Because fluid flow into needle control chamber 42 remains relatively unrestricted, even in the presence of dual flow rate orifice 41, the needle valve member 60 can be closed nearly as abruptly as that of the prior art. At the same time, spool valve member 35 again becomes hydraulically balanced and internal biasing spring 38 begins moving spool valve member 35 downward toward its downward position. However, because spring 38 is relatively weak, spool valve member 35 is accelerated downward at a relatively slow rate. Before it can move far enough to close radial openings 37, solenoid 31 is again energized to move ball valve member 34 downward. This again abruptly relieves the high pressure acting on annular hydraulic surface 36 and the closing hydraulic surface 66 of needle valve member 60. This causes spool valve member 35 to return to its upward most position, and allows needle valve member 60 to move toward its open position to resume fuel injection. However, because of the flow restriction created by dual flow rate orifice 41, the flow out of needle control chamber 42 is restricted relative to that of the prior art. This causes the resumption of fuel injection to be more gradual than that of the prior art because the flow restriction increases pressure in needle control chamber 42 and slows the upward movement of needle valve member 60.

At the end of the injection event, solenoid 31 is de-energized to again connect needle control passage 40 the high pressure fluid, which flows into needle control chamber 42 to push needle valve member 60 downward to end the injection event. Again, because dual flow rate orifice 41 permits relatively unrestricted flow into needle control chamber 42, the injection event can end about as abruptly as that of the prior art.

The above description is intended for illustrative purposes only, and is not intended to limit the scope of the present invention in any way. For instance, those skilled in the art will appreciate that the dual flow rate orifice of present invention can come in a wide variety of shapes and sizes. In addition, the present invention can also be incorporated into fuel injectors with direct control needle valves that utilize fuel as both the hydraulic medium and fuel fluid, whereas the illustrated embodiment shows the needle control chamber 42 connected to a source of high source of lubricating oil, and the nozzle outlet 23 connected to a source of distillate diesel fuel. Thus, various modifications could be made to the illustrated embodiment without departing from the intended spirit and scope of the present invention, which is defined in terms of the claims set forth below.

What is claimed is:

1. A nozzle assembly including:

a nozzle body defining a nozzle outlet, and a needle control chamber in fluid communication with a needle control passage;

a needle valve member positioned in said nozzle body and having a closing hydraulic surface exposed to fluid pressure in said needle control chamber, and being moveable between a first position in which said nozzle outlet is blocked and a second position in which said nozzle outlet is open;

said needle control passage including a dual flow rate orifice; and said needle valve member displacing fluid from said needle control chamber through said dual flow rate orifice when moving from said first position to said second position.

2. The nozzle assembly of claim 1 wherein said dual flow rate orifice has a first flow rate coefficient for fluid flow out of said needle control chamber;

said dual flow rate orifice has a second flow rate coefficient for fluid flow into said needle control chamber; and said first flow rate coefficient is substantially smaller than said second flow rate coefficient.

3. The nozzle assembly of claim 1 wherein said nozzle outlet is connected to a source of fuel fluid; and said needle control passage is connected to a source of hydraulic fluid that is different from said fuel fluid.

4. The nozzle assembly of claim 1 wherein said needle control passage is connectable to one of either a high pressure passage or a low pressure passage.

5. The nozzle assembly of claim 1 wherein fluid is displaced into said needle control chamber when said needle valve member moves from said second position toward said first position.

6. The nozzle assembly of claim 1 wherein said dual flow rate orifice includes a conical portion.

7. The nozzle assembly of claim 1 further including a compression spring operably positioned to bias said needle valve member toward said first position.

8. The nozzle assembly of claim 1 wherein said dual flow rate orifice is sufficiently restrictive to fluid flow that said needle valve member is hydraulically slowed when moving from said first position to said second position due to a pressure increase in said needle control chamber.

9. The nozzle assembly of claim 1 wherein said dual flow rate orifice is relatively restrictive to fluid flow out of said needle control chamber, but relatively unrestrictive to fluid flow into said needle control chamber.

10. A fuel injector including:

an injector body defining a nozzle outlet, and a needle control chamber in fluid communication with a needle control passage;

a needle valve member positioned in said injector body and having a closing hydraulic surface exposed to fluid pressure in said needle control chamber, and being moveable between a first position in which said nozzle outlet is blocked and a second position in which said nozzle outlet is open;

said needle control passage including a dual flow rate orifice;

hydraulic fluid being displaced into said needle control chamber through said dual flow rate orifice when said needle valve member moves from said second position toward said first position, and said hydraulic fluid being displaced out of said needle control chamber through said dual flow rate orifice when said needle valve member moves from said first position toward said second position; and a compression spring operably positioned to bias said needle valve member toward said first position.

11. The fuel injector of claim 10 wherein said dual flow rate orifice is sufficiently restrictive to fluid flow that said needle valve member is hydraulically slowed when moving from said first position to said second position due to a pressure increase in said needle control chamber.

12. The fuel injector of claim 11 wherein said dual flow rate orifice has a first flow rate coefficient for fluid flow out of said needle control chamber;

said dual flow rate orifice has a second flow rate coefficient for fluid flow into said needle control chamber; and said first flow rate coefficient is substantially smaller than said second flow rate coefficient.

13. The fuel injector of claim 12 wherein said nozzle outlet is connected to a source of fuel fluid; and said needle control passage is connected to a source of hydraulic fluid that is different from said fuel fluid.

14. The fuel injector of claim 13 further including a needle control valve attached to said injector body, and being moveable between an on position in which said needle control passage is open to a low pressure passage, and an off position in which said needle control passage is open to a high pressure passage.

15. The fuel injector of claim 14 wherein said dual flow rate orifice includes a conical portion.

16. The fuel injector of claim 14 wherein said dual flow rate orifice is sufficiently restrictive to fluid flow that said needle valve member is hydraulically slowed when moving from said first position to said second position due to a pressure increase in said needle control chamber.

17. The fuel injector of claim 14 wherein said dual flow rate orifice is relatively restrictive to fluid flow out of said needle control chamber, but relatively unrestrictive to fluid flow into said needle control chamber.

18. A fuel injector including:

an injector body defining a nozzle outlet, and a needle control chamber in fluid communication with a needle control passage;

a needle valve member positioned in said nozzle body and having a closing hydraulic surface exposed to fluid pressure in said needle control chamber, and being moveable between a first position in which said nozzle outlet is blocked and a second position in which said nozzle outlet is open;

said needle control passage including a dual flow rate orifice with a conical portion; and said needle valve member displacing fluid from said needle control chamber through said at least one dual flow rate orifice when moving from said first position to said second position;

a compression spring operably positioned in said injector body to bias said needle valve member toward said first position;

said at least one dual flow rate orifice being sufficiently restrictive to fluid flow that said needle valve member is hydraulically slowed when moving from said first position to said second position due to a pressure increase in said needle control chamber;

said dual flow rate orifice has a first flow rate coefficient for fluid flow out of said needle control chamber, and a second flow rate coefficient for fluid flow into said needle control chamber; and said first flow rate coefficient is substantially smaller than said second flow rate coefficient.

19. The fuel injector of claim 18 further including a needle control valve attached to said injector body, and being moveable between an on position in which said needle control passage is open to a low pressure passage, and an off position in which said needle control passage is open to a high pressure passage.

20. The fuel injector of claim 19 wherein said nozzle outlet is connected to a source of fuel fluid; and said needle control passage is connected to a source of hydraulic fluid that is different from said fuel fluid.

* * * * *